US006585059B2

(12) United States Patent
Michael, Jr. et al.

(10) Patent No.: US 6,585,059 B2
(45) Date of Patent: Jul. 1, 2003

(54) MOTOR GRADER BLADE RETENTION SYSTEM

(75) Inventors: David R. Michael, Jr., Normal, IL (US); Donald R. Mast, Decatur, IL (US); Wayne R. Tanner, Chicago, IL (US)

(73) Assignee: Caterpillar Inc., Peoria, IL (US)

( * ) Notice: Subject to any disclaimer, the term of this patent is extended or adjusted under 35 U.S.C. 154(b) by 8 days.

(21) Appl. No.: 09/882,055

(22) Filed: Jun. 18, 2001

(65) Prior Publication Data

US 2003/0042029 A1 Mar. 6, 2003

(51) Int. Cl.[7] ..... E02F 3/76
(52) U.S. Cl. ..... 172/811
(58) Field of Search ..... 172/810, 811, 172/781; 37/266; 248/229.13, 229.23, 228.4, 230.4, 231.51

(56) References Cited

U.S. PATENT DOCUMENTS 3,463,243 A * 8/1969 Fisher ..... 172/781
3,465,829 A * 9/1969 Fisher et al. ..... 172/667
3,593,806 A * 7/1971 Gurries ..... 172/741
3,735,818 A 5/1973 Swisher, Jr. et al.
3,880,243 A 4/1975 Gurries et al.
4,074,767 A * 2/1978 Cole ..... 172/741
4,084,643 A * 4/1978 Easterling ..... 172/743
4,105,078 A * 8/1978 Gilbert ..... 172/741
4,683,959 A * 8/1987 Clemens ..... 172/667
5,076,370 A * 12/1991 Stubben et al. ..... 172/684.5
5,687,800 A 11/1997 Wilkening

OTHER PUBLICATIONS

Autoblade Tracer Grader, A Totally New Concept in Motor-grading, CMI Corporation, No Date Given.
Grader in Action, No date given.

* cited by examiner

*Primary Examiner*—Thomas B. Will
*Assistant Examiner*—Kristine Florio
(74) *Attorney, Agent, or Firm*—Sughrue Mion Zinn Macpeak

(57) ABSTRACT

A mounting assembly for mounting a blade assembly to a motor grader includes an upper and a lower retainer pivotally coupled together. The upper and lower retainers are pivotable about a single axis with respect to each other for grasping the blade assembly therebetween.

7 Claims, 5 Drawing Sheets

MOTOR GRADER BLADE RETENTION SYSTEM

TECHNICAL FIELD

The present invention relates generally to a motor grader, and more particularly, to an apparatus and method for retaining a grader blade.

BACKGROUND

Motor graders are typically used to perform displacement, distribution and leveling of material, such as soil. Generally, a motor grader includes a tractor unit coupled to a grader group via a tow bar assembly. The grader group includes a blade assembly having a grader blade, as well as a mounting assembly having a support bracket with retainers extending therefrom. The blade assembly is positioned in the retainers such that the grader blade is supported by the support bracket. Wear strips are provided between the retainers and the blade assembly to facilitate the retention of the grader blade in the assembly, while allowing sliding movement of the blade assembly with respect to the retainers. The tractor unit moves the blade assembly over the ground, so that the grader blade engages with the material, such as soil, so as to displace, distribute or level the soil.

During use of the motor grader, the grader blade is tipped and sideshifted, to manipulate the material as discussed above. The wear strips tend to erode during use, thus loosening the retention of the grader blade so that there is unintended motion between the grader blade and support bracket. A loose grader blade inhibits the accurate displacement, distribution and leveling of the material.

To overcome this problem, shims are installed to fill any horizontal gaps caused by the erosion of the wear strips. However, using shims is work intensive, and thus increases the maintenance cost of the motor grader. Moreover, the insertion of shims only inhibits, and does not effectively stop, the unintended motion between the grader blade and the support bracket.

U.S. Pat. No. 5,687,800 provides a retaining apparatus in which the necessity of shims is reduced. In particular, a retaining apparatus having a turnbuckle mechanism facilitates the tightening of the fit between the retainers and the blade assembly as the wear strips erode. However, the turnbuckle mechanism is complex. In addition, the turnbuckle mechanism only allows for a limited movement of the retainers with respect to each other, and thus, the method for assembling the blade assembly to the mounting assembly is cumbersome because the blade assembly must be slid sideways into the retainers. Also, the wear strips must be aligned between the retainer and the blade assembly. The present invention is intended to overcome these and other problems of conventional motor grader retention systems, by providing a retaining system in which the mechanism for adjusting the fit of the retainers is simple, the wear strips are self-aligning, and the method for assembling the blade assembly to the mounting assembly is efficient.

SUMMARY OF THE INVENTION

According to a first aspect of the invention, a mounting assembly for mounting a blade assembly to a motor grader, is provided with an upper and lower retainer pivotally coupled together, wherein the upper and lower retainers are pivotable about a single axis with respect to each other for grasping the blade assembly therebetween.

According to a second aspect of the invention, a wear strip for mounting a blade assembly to a mounting assembly of a motor grader includes a member having a flat inner surface and a curved outer surface, wherein the curved outer surface mates with the mounting assembly and the flat inner surface mates with the blade assembly.

According to a third aspect of the invention, a method for assembling a mounting assembly to upper and lower blade rails of a blade assembly is provided. The mounting assembly includes upper and lower retainers pivotally coupled together, and self-aligning wear strips. The method includes the steps of pivoting the upper and lower retainers away from each other, placing the upper retainer over the upper blade rail and placing the lower retainer under the lower blade rail, and pivoting the upper and lower retainers toward each other until the upper and lower blade rails are securely fitted to the upper and lower retainers with the self-aligning wear strips disposed therebetween.

BRIEF DESCRIPTION OF THE DRAWINGS

The invention will be more fully understood from the following detailed description of the preferred embodiments, taken in connection with the accompanying drawings, in which.

DETAILED DESCRIPTION

A preferred embodiment of the invention will now be described in reference to the accompanying drawings.

Figure 1:
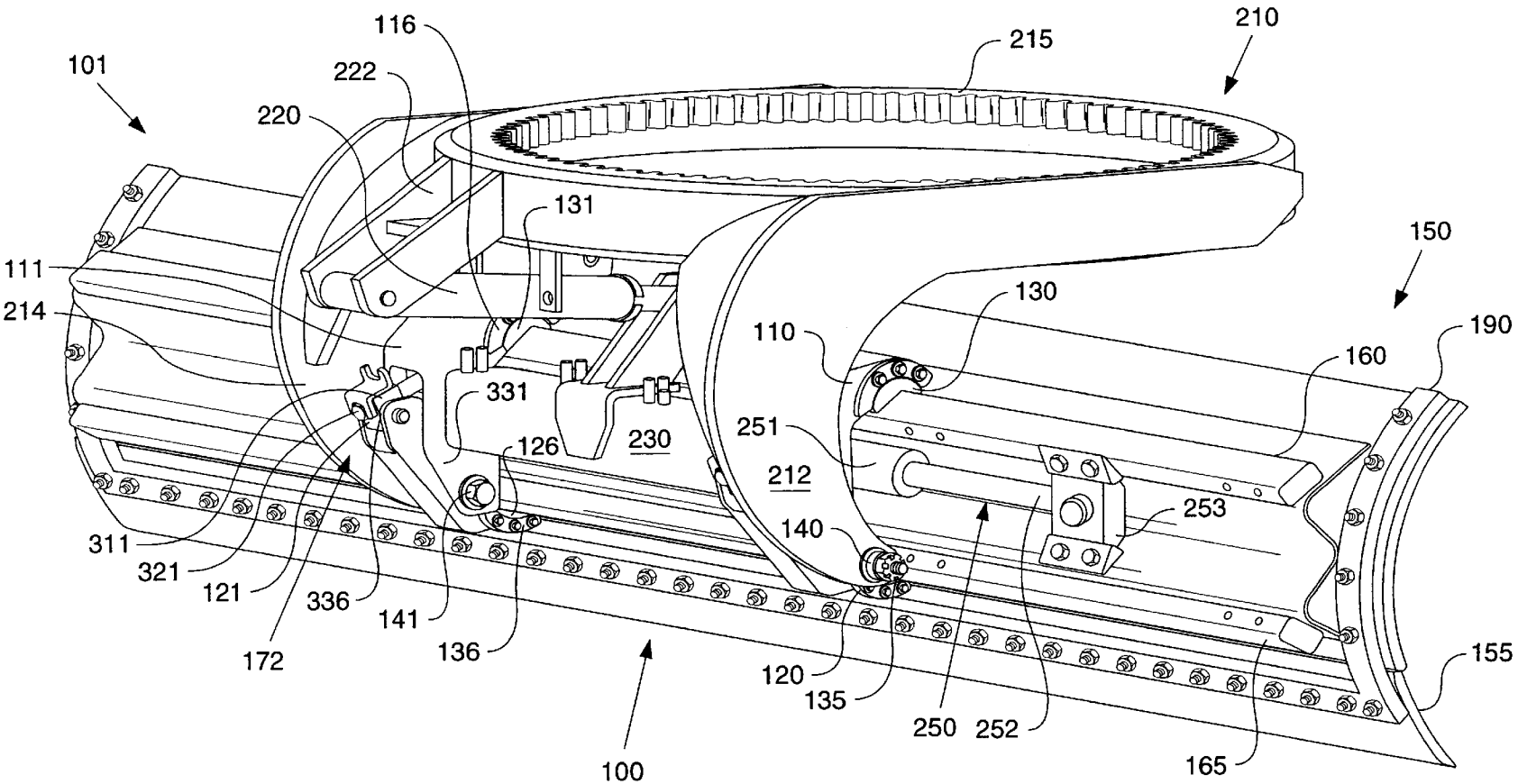
FIG. 1 is a perspective view of the grader group having the mounting assembly coupled to the blade assembly.

Referring to FIG. 1, a grader group 101 for a motor grader is shown. The grader group 101 includes a mounting assembly 100 and a blade assembly 150. The mounting assembly 100 supports the blade assembly 150 on the motor grader. In addition, a circle assembly 210 supports the mounting assembly 100 to the motor grader.

The grader group 101 is pivotable up and down with respect to the circle assembly 210. The blade assembly 150 is slidable side-to-side with respect to the mounting assembly 100, and is rotatable with respect to the circle assembly 210. The combination of these motions allow the blade assembly 150 to displace, distribute and level a material as desired by the operator of the motor grader.

Figure 2:
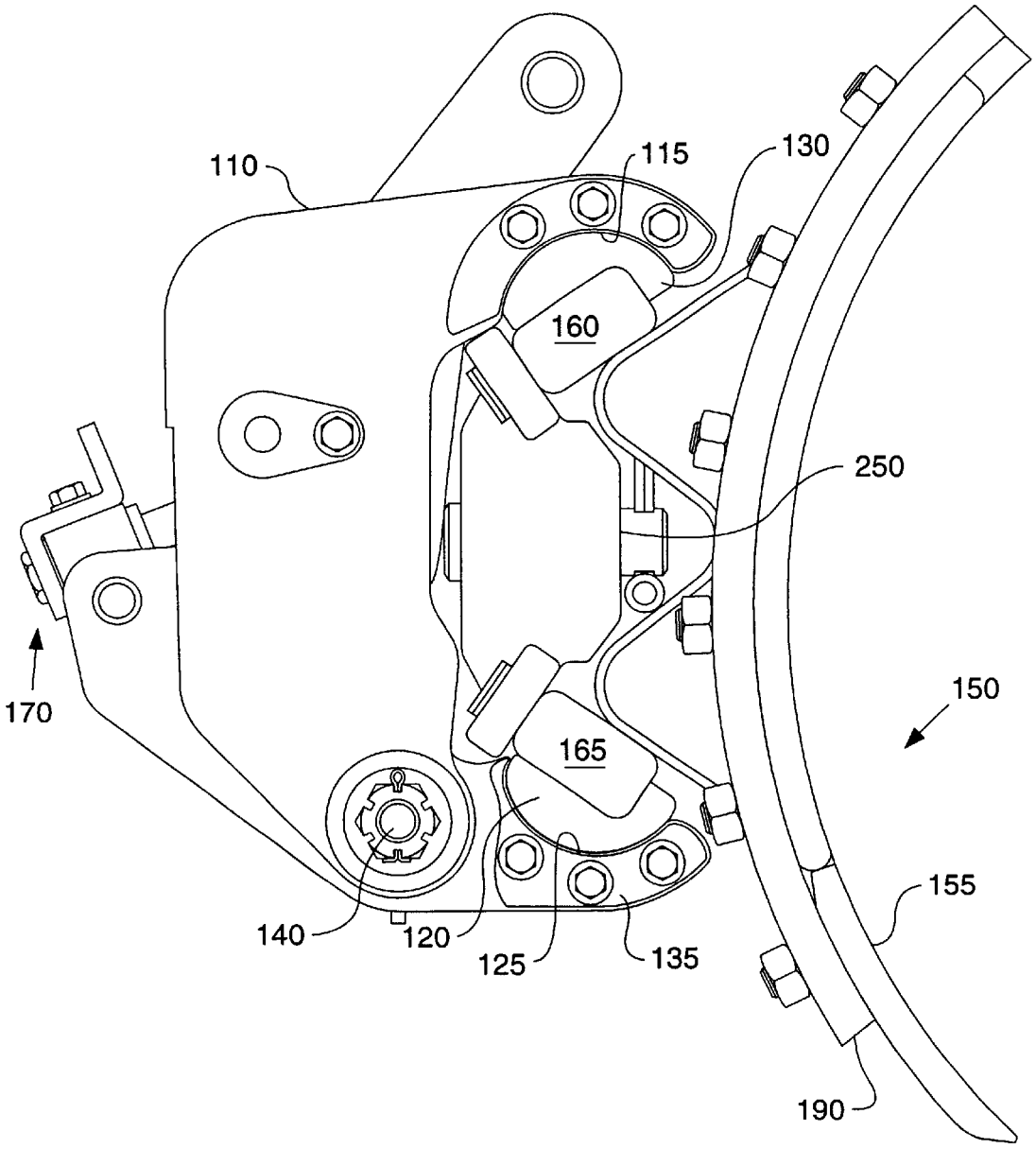
FIG. 2 is a side view of the mounting assembly coupled to the blade assembly.

The mounting assembly 100 includes (see FIG. 2) a first upper retainer 110, a second upper retainer 111, a first lower retainer 120, a second lower retainer 121, a first upper wear strip 130, a second upper wear strip 131, a first lower wear strip 135, a second lower wear strip 136, a first retainer pin 140, a second retainer pin 141, and first and second adjustment mechanisms 170, 172.

The circle assembly 210 includes a circle member 215, a first support arm 212 and a second support arm 214. The first support arm 212 and the second support arm 214 are secured to the circle member 215. The first support arm 212 is pivotally mounted to the first upper retainer 110 via the first retainer pin 140. The second support arm 214 is pivotally mounted to the second upper retainer 111 via the second retainer pin 141.

The first upper retainer 110 and the first lower retainer 120 are pivotally coupled to each other via the first retainer pin 140. The first upper retainer 110 and the first lower retainer 120, therefore, are pivotable about a single axis X which corresponds with the longitudinal axis of the first retainer pin 140 when the retainers 110, 120 and pin 140 are assembled (see FIG. 3). The second upper retainer 111 and the second lower retainer 121 are arranged to be pivotally coupled in the same general manner.

The first upper retainer 110 includes a first upper cylindrical cavity 115 in which the first upper wear strip 130 is disposed. The first lower retainer 120 includes a first lower cylindrical cavity 125 in which the first lower wear strip 135 is disposed. Similarly, the second upper retainer 111 has a second upper cylindrical cavity 116, and the second lower retainer 121 has a second lower cylindrical cavity 126 for receiving the second upper and lower wear strips 131, 136, respectively.

The cylindrical cavities 115, 116, 120, 121 may be formed in a half-moon shape, crescent shape, or similar shape wherein a rounded inner surface that defines the cavity generally corresponds to the shape of a portion of the outer surface of the associated wear strip placed therein.

Figure 3:
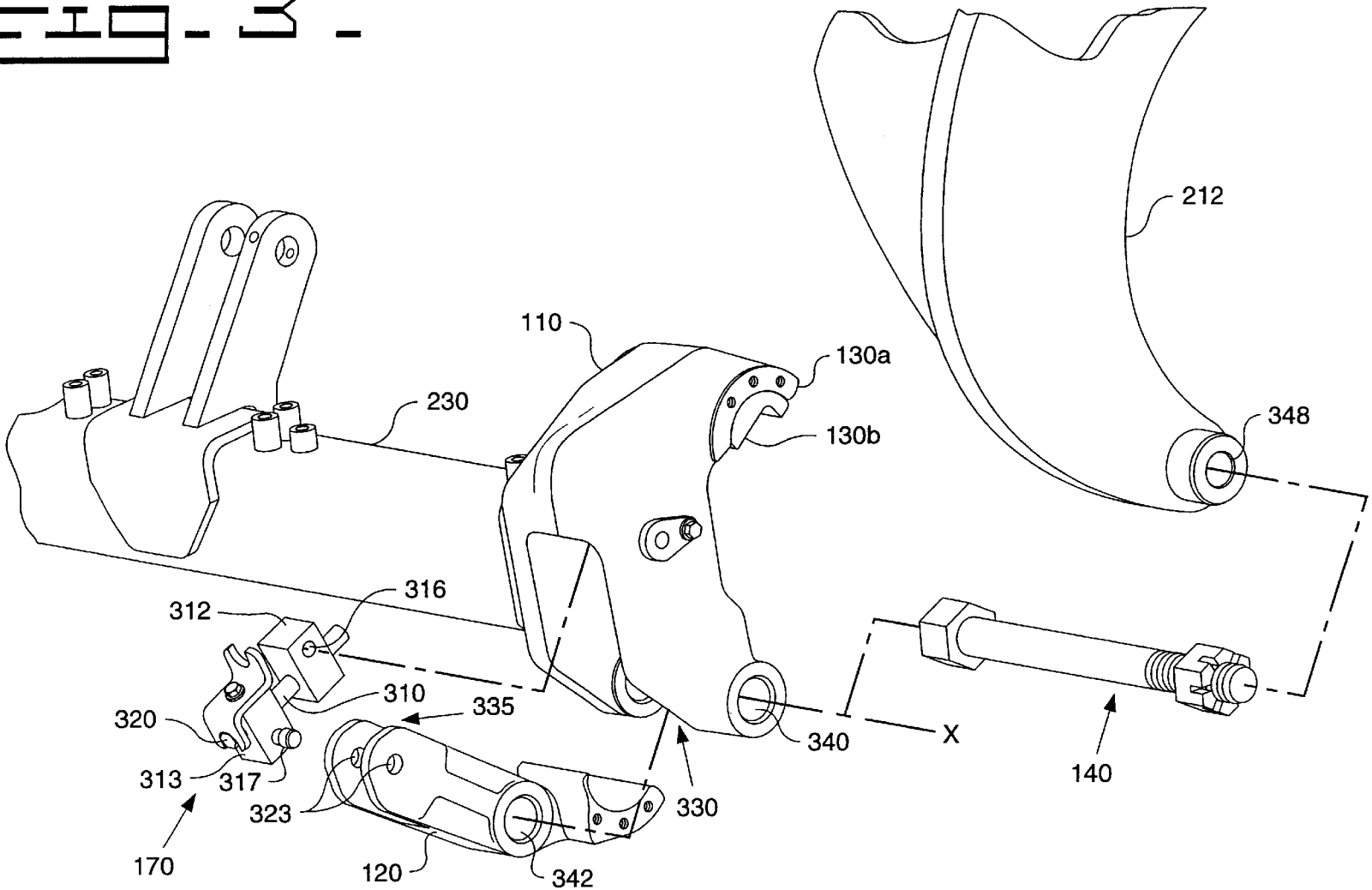
FIG. 3 is an exploded view of the mounting assembly.

The first upper wear strip 130, for example, has a curved outer surface 130*a* and a flat inner surface 130*b* (see FIG. 3). The curved outer surface 130*a* corresponds in shape to the inner surface of the first upper cylindrical cavity 115. Each of the wear strips 130, 131, 135, 136 may include this structure of a curved outer surface and a flat inner surface, wherein the curved outer surface facilitates the self-aligning feature of the present invention, as discussed in greater detail below.

The blade assembly 150 includes a moldboard 190, an upper blade rail 160 and a lower blade rail 165, and a grader blade 155. The grader blade 155 is attached to a first side, or front, of the moldboard 190 and the upper and lower blade rails 160, 165 are attached to a second side, or rear, of the moldboard 190.

The upper blade rail 160 is retained to the mounting assembly 100 so that the upper wear strips 130, 131 are respectively disposed between the upper blade rail 160 and the upper retainers 110, 111. Similarly, the lower blade rail 165 is retained to the mounting assembly 100 so that the lower wear strips 135, 136 are respectively disposed between the lower blade rail 165 and the lower retainers 120, 121.

The circle assembly 210 also includes a tip support member 222 for supporting a tip cylinder 220 thereto. The tip cylinder 220 is secured to a support bracket 230 of the mounting assembly 100.

A side shift cylinder assembly 250 (see FIG. 1) is provided for shifting the grader blade 155 side-to-side with respect to the mounting assembly 100. The cylinder assembly 250 includes a cylinder portion 251 that is attached to the second upper retainer 111, and a piston portion 252 that is connected to the upper and lower blade rails 160, 165 via a cylinder mount 253. Actuation of the cylinder assembly 252 causes the upper and lower blade rails 160, 165 to slide with respect to the second upper retainer 111, and therefore, the mounting assembly 100. Thus, the upper and lower blade rails 160, 165 slide with respect to the wear strips 130, 135, 131, 136.

Each of the first and second upper retainers 110, 111 includes first and second upper U-shaped retaining members 330, 331, respectively. Each of the first and second lower retainers 120, 121 includes first and second lower U-shaped retaining members 335, 336. In the embodiment illustrated in FIG. 3, the first and second lower retainers 120, 121 fit between the U-shaped retaining members 330, 331 of the first and second upper retainers 110, 111, respectively, and are pivotally held by pins 140, 141, respectively. Of course, it should be understood that the first and second upper retainers 110, 111 could alternatively fit within the U-shaped retaining members 335, 336 of the first and second lower retainers 120, 121.

The first upper retainer 110 has first upper retainer pin holes 340 and the first lower retainer 120 has first lower retainer pin holes 342. Additionally, the first support arm 212 has a first support arm retainer pin hole 348. The first retainer pin 140 fits within the first upper and lower retainer pin holes 340, 342 and the first support arm retainer pin hole 348 to pivotally connect the first upper retainer 110 to the first lower retainer 120.

Similarly, although hidden from view in the Figures, the second upper retainer 111 has second upper retainer pin holes and the second lower retainer 121 has second lower retainer pin holes. Additionally, the second support arm 214 has a second support arm retainer pin hole. The second retainer pin 141 fits within the second upper and lower retainer pin holes and the second support arm retainer pin hole as described above with respect to the first upper and lower retainer 110, 120 assembly. Hence, the second upper retainer 111 is pivotal with respect to the second lower retainer 121.

Figure 5:
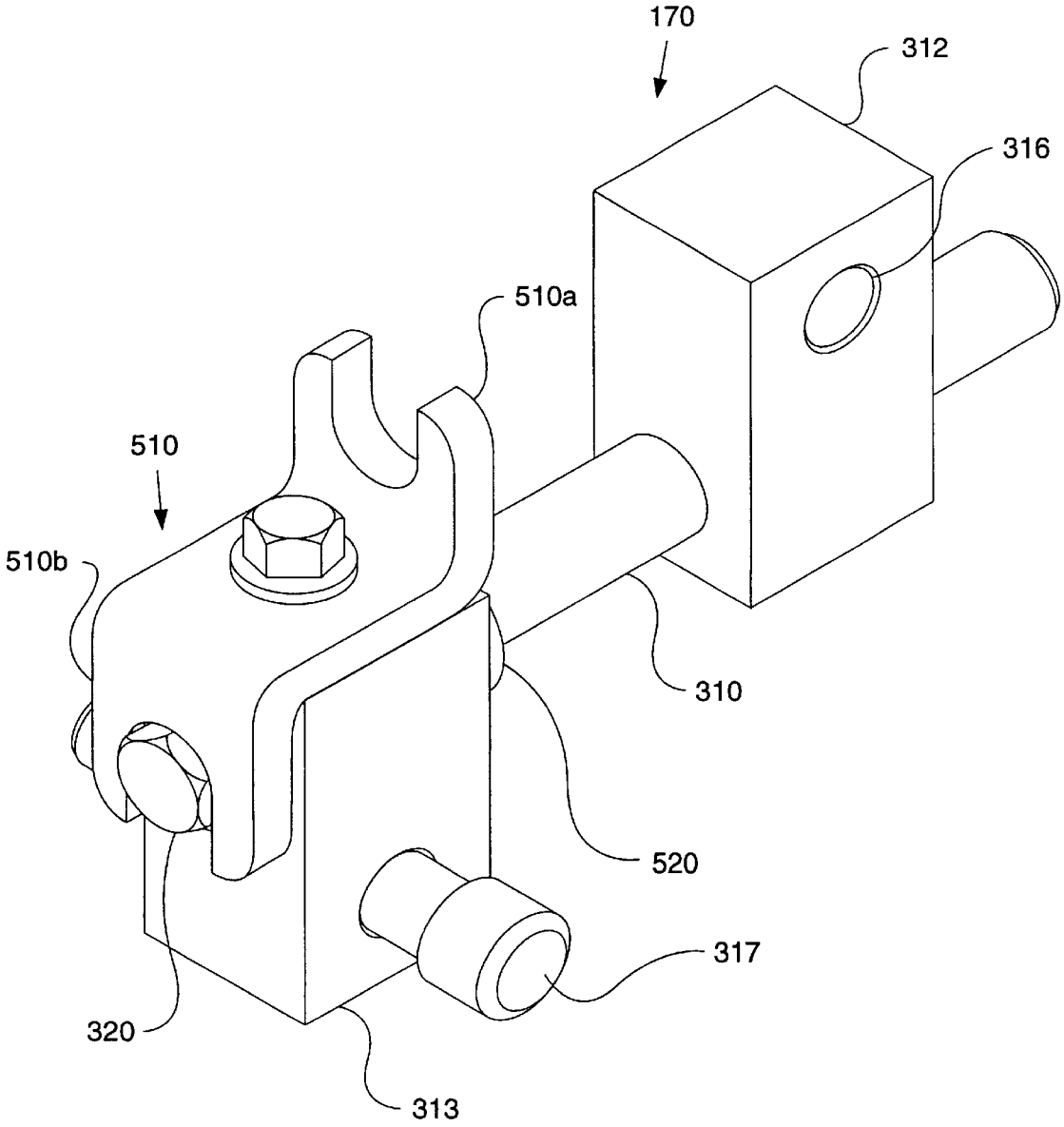
FIG. 5 is an enlarged view of the adjustment mechanism.

The first adjustment mechanism 170 is shown in detail in FIGS. 3 and 5. Although the second adjustment mechanism 172 is not described in detail, its structure is similar to the first adjustment mechanism 170. The first and second adjustment mechanisms 170, 172 allow for the upper and lower retainers to be pivoted with respect to each other, as discussed in detail below.

The first adjustment mechanism 170 includes a first adjustment screw 310 threadingly engaged with a first upper adjustment block 312. The first adjustment screw 310 is also engaged with a first lower adjustment block 313, however, it is slidingly engaged and not threaded thereto. The first upper adjustment block 312 is coupled to the first upper retainer 110 by a first upper retainer pin (not shown) received in a first upper adjustment pin hole 316 of the first upper adjustment block 312. The first lower adjustment block 313 is coupled to the first lower retainer 120 by a first lower adjustment pin 317 received in first lower retainer pin holes 323 of the first lower retainer 120.

In addition, one end of the first adjustment screw 310 may be provided with a first hex head 320 for facilitating rotation of the first adjustment screw 310 with a tool, such as a socket wrench.

A flange 520 is fixed to the first adjustment screw 310 so as to abut against one side of the first lower adjustment block 313. A bracket 510 is detachably connected to the adjustment mechanism 170. In particular, the bracket 510 is secured to the first lower adjustment block 313 by a bolt or other similar device so as to be removable from the first lower adjustment block 313. The operation of the first adjustment mechanism 170 is described in greater detail below.

To the extent possible, FIG. 1 shows the second adjustment mechanism 172. As shown, a second hex head 321 is provided at the end of a second adjustment screw 311. Although the second upper and lower adjustment blocks, the second upper and lower adjustment pins, and the second upper and lower retainer adjustment pin holes are hidden from view, these elements are understood to have a similar structure to the first adjustment mechanism.

INDUSTRIAL APPLICABILITY

In order to attach the blade assembly 150 to the mounting assembly 100, the first and second adjustment mechanisms 170, 172 cause the upper and lower retainers 110, 111, 120, 121 to pivot about the retainer pivot pins' 140, 141 axes so that the cylindrical cavities 115, 116, 125, 126 move away from each other, respectively. The blade assembly 150 is then inserted within an opening between the upper and lower retainers 110, 111, 120, 121, and then the first and second adjustment mechanisms 170, 172 cause the upper and lower retainers 110, 111, 120, 121 to move toward each other. This process will now be described in further detail, with respect to the first upper and lower retainers.

Figure 4:
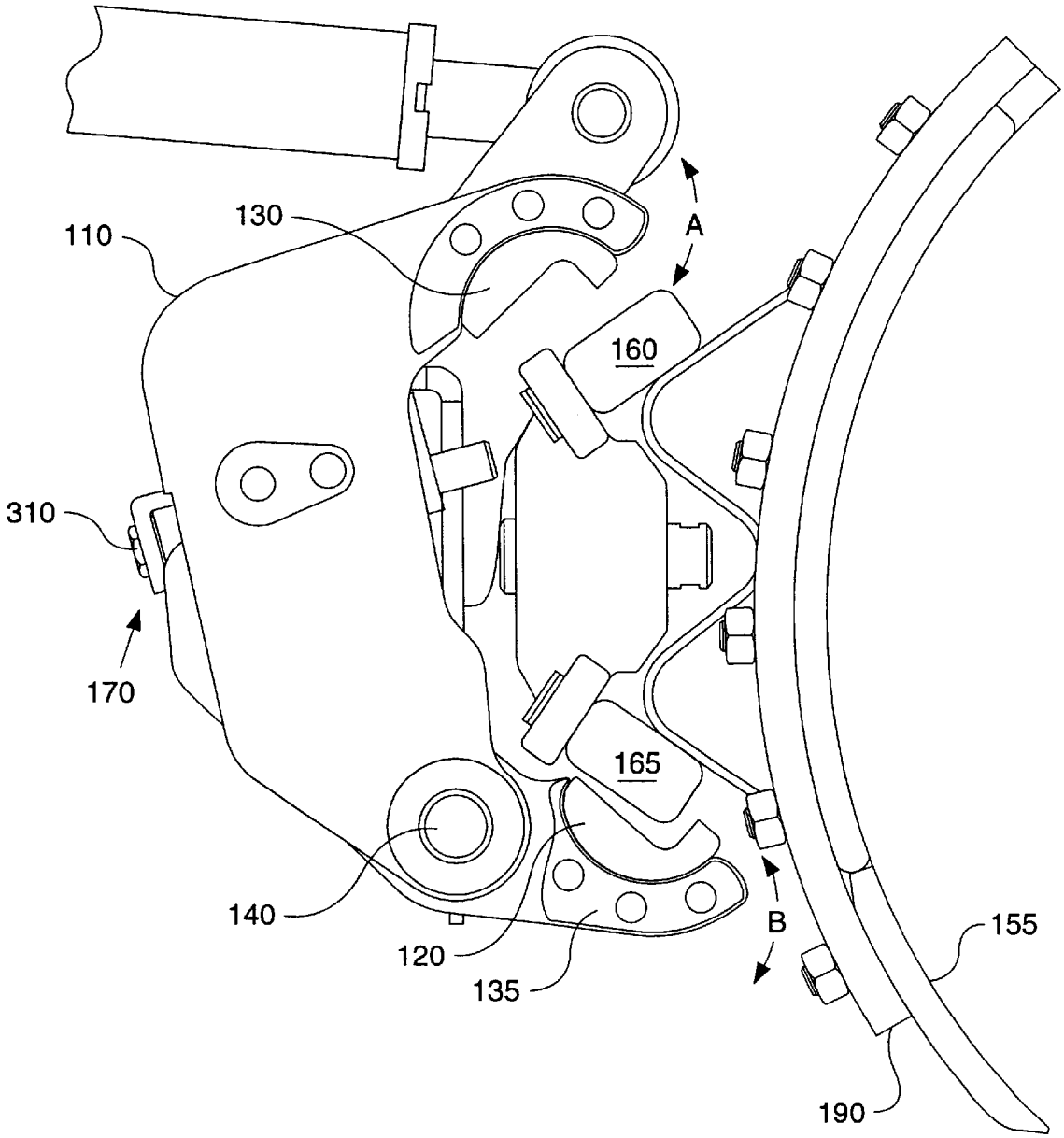
FIG. 4 is a side view of the mounting assembly in an open position for receiving the blade assembly.

Referring to FIG. 4, the first upper and lower retainers 110, 120 are shown. The first upper and lower retainers 110, 120 pivot about the pivot pin 140, in a scissor-like fashion. In other words, the first upper and lower retainers 110, 120 together form a jaw which opens and closes as indicated by the arrows A, B, to allow for the insertion of the blade rails 160, 165 of the blade assembly 150.

The first adjustment screw 310 is rotated to cause the first upper and lower retainers 110, 120 to pivot. The first adjustment screw 310 is rotatable in a first direction to cause the jaw to open, and in a second direction to cause the jaw to close. In particular, as the first adjustment screw 310 rotates, the first upper and lower adjustment blocks 312, 313 move with respect to each other thereby causing the first upper and lower retainers 110, 120 to pivot with respect to each other.

FIG. 5 illustrates the bracket 510 in a locked position, wherein the hex head 320 is prevented from accidentally rotating due to vibrations, etc. In particular, a second end 510*b* partially covers the hex head 320 so that it cannot unintentionally rotate. In order to operate the first adjustment mechanism 170, the bracket 510 is removed and then flipped and replaced so that the first end 510*a* fits over the flange 520. This secures the flange 520 to the first lower adjustment block 313 via the bracket 520. This position also frees the hex head 320 to rotate.

As the first adjustment screw 310 rotates, it causes the first upper and lower adjustment blocks 312, 313 to move closer together (or farther apart depending on the rotation direction of the first adjustment screw 310) due to the threaded engagement of the first adjustment screw 310 with the first upper adjustment block 312. As the first adjustment screw 310 rotates, the first upper adjustment block 312 moves along the length of the first adjustment screw 310 due to their threaded engagement. Thus, the first upper adjustment block 312 is caused to move closer to, or further from, the first lower adjustment block 313 since the first lower adjustment block 313 is fitted against the flange 520 by the first end 510*a*.

As the first upper and lower adjustment blocks 312, 313 move closer together, the upper and lower retainers 110, 120 pivot about the single axis X due to the engagement of the first upper adjustment pin hole 316 to the first upper adjustment pin of the first upper retainer 110, and the respective engagement of the first lower adjustment pin 317 to the first lower adjustment pin hole 323 of the first lower retainer 120.

The upper and lower blade rails 160, 165 are then placed in position so that as the jaw of the upper and lower retainers 110, 120 closes, the upper and lower blade rails 160, 165 will be retained therein with the first upper and lower wear strips 130, 135 disposed therebetween. As the first adjustment screw 310 is further rotated, the jaw of the upper and lower retainers 110, 120 tightens against the upper and lower blade rails 160, 165 so that the first upper and lower wear strips 130, 135 are securely held therein, thereby completing the attachment of the mounting and blade assemblies 100, 150.

Thus, the cumbersome process of sliding the blade assembly 150 into the side of mounting assembly 100 is eliminated, and instead, the blade assembly 150 can be easily and directly placed into the retainers of the mounting assembly 100 so as to be grasped by the mounting assembly 100.

The curved shape of the first upper and lower wear strips 130, 135 facilitate the self-alignment of the wear strips 130, 135 within the first upper and lower cylindrical cavities 115, 125 as the first upper and lower retainers 110, 120 tighten against the upper and lower blade rails 160, 165. Thus, the wear strips 130, 135 do not have to be additionally manipulated into alignment when the blade assembly 150 is secured to the mounting assembly 100; the wear strips 130, 135 automatically self-align as the assemblies are secured together.

The shape of the first upper and lower wear strips 130, 135 is not limited to that illustrated in the Figures. A semi-cylindrical surface is shown in the Figures, but the curved surface may be smaller or larger than a half-circle. The curved surface may be more or less than ½ the periphery of the wear strip.

As the first upper and lower wear strips 130, 135 erode over a period of extended use of the blade assembly 150, the first adjustment screw 310 can be further tightened to remove any gaps that form due to this erosion. Due to the curved surfaces of the first upper and lower wear strips 130, 135, the wear strips 130, 135 tend to self-align as the first adjustment screw 310 is tightened. Thus, the use of shims is avoided without requiring a complicated structure for filling the gaps of the wear strips.

After the blade assembly 150 is properly mounted to the mounting assembly 100, the bracket 510 may be repositioned so that the hex head 320 is once again locked into position by the second end 510*b*. This locking position prevents the adjustment screw 310 from unintentionally rotating due to vibrations, etc. Thus, the blade rails 160, 165 are prevented from unintentionally loosening with respect to the first upper and lower retainers 110, 120.

The above description is directed to the first upper and lower retainers 110, 120, first upper and lower wear strips 130, 135, first adjustment mechanism 170, and their associated components. The second upper and lower retainers 111, 121, second upper and lower wear strips 131, 136, and the second adjustment mechanism 172 are operated in the same manner as that discussed above.

Shown and described are several preferred embodiments of the invention, though it will be apparent to those skilled in the art that many changes and modifications may be made without departing from the invention in its broader aspects. For instance, a third upper and lower retainer may be provided, or only a single upper and lower retainer may be provided, for engaging with the blade rails 160, 165. Therefore it is intended that the appended claims cover all such changes and modifications as fall within the true spirit and scope of the invention.

What is claimed is:

1. A mounting assembly for mounting a blade assembly to a motor grader, comprising:

an upper and a lower retainer pivotally coupled together, at least one of said upper and lower retainer having a arcuate cavity for retaining a wear strip therein, wherein said upper and lower retainers are pivotable about a single axis with respect to each other for grasping said blade assembly therebetween.

2. The mounting assembly according to claim 1, wherein at least one of said wear strips has a curved outer surface corresponding to an inner surface of said circular cavity of each of said upper and lower retainers.

3. The mounting assembly according to claim 2, wherein said curved surface is provided along at least ½ of a periphery of each of said wear strips.

4. The mounting assembly according to claim 1, wherein said circular cavity has a crescent shape.

5. The mounting assembly according to claim 1, further including an adjustment mechanism coupled to said upper and lower retainers for facilitating rotation of said upper and lower retainers about said single axis.

6. The mounting assembly according to claim 5, wherein said adjustment mechanism includes an adjustment screw inserted through a first and second adjustment block, wherein said first adjustment block is coupled to said upper retainer and said second adjustment block is coupled to said lower retainer, and wherein said adjustment screw is rotated to cause said first and second adjustment block to move with respect to each other, thereby pivoting said upper and lower retainers with respect to each other.

7. The mounting assembly according to claim 6, wherein said adjustment screw is threadingly engaged with said first adjustment block and said adjustment screw is slidingly engaged with said second adjustment block, said adjustment mechanism further including a flange extending from said adjustment screw so as to abut said second adjustment block and a bracket detachably secured to said second adjustment block.

* * * * *